United States Patent [19]

Escalera

[11] 4,337,149

[45] Jun. 29, 1982

[54] PROMOTERS FOR USE IN THE ANIONIC CIRCUIT OF FROTH FLOTATION OF MINERAL ORES

[75] Inventor: Saul J. Escalera, Dublin, Ohio

[73] Assignee: Sherex Chemical Company, Inc., Dublin, Ohio

[21] Appl. No.: 262,417

[22] Filed: May 11, 1981

[51] Int. Cl.[3] ..... B03D 1/02

[52] U.S. Cl. ..... 209/166; 252/61

[58] Field of Search ..... 209/166, 167; 252/61, 252/8.55 C; 210/704

[56] References Cited

U.S. PATENT DOCUMENTS

| | | | |
|---|---|---|---|
| 2,259,420 | 10/1941 | Hills | 209/166 |
| 2,302,338 | 11/1942 | Mueller | 209/166 |
| 2,335,485 | 11/1943 | Christmann | 209/166 |
| 2,364,272 | 12/1944 | Christmann | 209/166 |
| 2,520,119 | 10/1951 | Nondley | 209/166 X |
| 2,569,680 | 10/1951 | Leek | 209/166 X |
| 2,578,790 | 12/1951 | Duke | 209/166 |
| 3,278,028 | 10/1966 | Millsapps | 209/166 |
| 4,045,335 | 8/1977 | Adams | 209/166 |
| 4,108,782 | 8/1978 | Thompson | 252/8.55 C |
| 4,128,475 | 12/1978 | Wong | 209/166 |
| 4,206,045 | 6/1980 | Wong | 209/166 |

FOREIGN PATENT DOCUMENTS

| | | | |
|---|---|---|---|
| 1146824 | 4/1963 | Fed. Rep. of Germany | 262/61 |

*Primary Examiner*—Robert Halper

*Attorney, Agent, or Firm*—Mueller and Smith

[57] ABSTRACT

An improved froth flotation process wherein preselected particles are selectively separated under froth flotation conditions as a froth phase from remaining feed particles as an aqueous phase in the presence of an anionic collector. Such improvement is characterized by the addition of an effective proportion of a promoter. The promoter is characterized as an amine oxide promoter. Preferred feed particles are phosphate ore particles.

30 Claims, No Drawings

PROMOTERS FOR USE IN THE ANIONIC CIRCUIT OF FROTH FLOTATION OF MINERAL ORES

BACKGROUND OF THE INVENTION

The present invention relates to the froth flotation of mineral ores and more particularly to unique promoters useful in the anionic circuit of froth flotation of phosphate and other mineral ores.

It is common practice in froth flotation to utilize a chemical collector which is selectively adsorbed on the surface of the particles to be collected in order to enhance the concentration of such particles in one phase (usually the froth phase) while leaving remaining particles in the other phase (usually the aqueous phase). For example, phosphate ores have been beneficiated traditionally by employment of a double flotation process wherein the phosphate sands are screened to remove coarse phosphate pebbles (usually larger than about 1.15 mm) and then attrition scrubbed and classified to remove fine clay minerals referred to as slimes in order to prepare the sands for admission to the first stage of the flotation process. In the first flotation stage (so-called rougher flotation) the ore, normally containing 10–30% bone phosphate of lime (BPL), is upgraded to about 40–65% BPL by utilization of crude tall oil carboxylic acid collectors, typically derived as a by-product from the paper industry. The resulting phosphate concentrate from the anionic flotation circuit typically is an unsaleable product because the silica or acid insoluble content is too high, normally ranging from about 8–40%. to reduce the insoluble content to about 5% or less, the concentrate from the first or anionic flotation stage is acid scrubbed, eg. with sulfuric acid, to desorb the carboxylic acid collectors and again deslimed to remove both slimes and the chemical collectors. The ore pulp then is neutralized to approximately pH 7 with, for example, caustic soda or ammonium hydroxide, and sent to a secondary (or cleaner) flotation stage wherein cationic collectors are used to upgrade further the proportion of BPL by reverse flotation of the silica impurity.

The tall oil fatty acid collectors and extender fuel oils used as reagents in the anionic circuit or rougher flotation of phosphatic particles are effective in the flotation of coarse sized ore particles greater than about 35 mesh (Typer standard sieve series); however, the foam bearing such coarse phosphate ore particles is unstable which makes the rougher flotation recovery yield below 80% on the average. A further problem encountered in the rougher flotation is that the fatty acid collectors are known to form micellar structures at the relatively high concentrations that are used in the phosphate flotation process. This phenomena hinders the absorption of the collectors on the solid phosphatic particles which is deleterious to the process.

Heretofore, amine oxides have proven to be highly effective promoters in the froth flotation of sylvite from sylvinite ores wherein cationic amine collectors are used, as disclosed in applicant's commonly assigned co-pending application Ser. No. 066,637, filed on Aug. 15, 1979. The present invention is based upon the unexpected and startling discovery that such amine oxides and other promoters are highly effective in promoting flotation of ores in anionic systems.

BROAD STATEMENT OF THE INVENTION

The present invention is an improved froth flotation process wherein preselected particles are selectively separated under froth flotation conditions as a froth phase from remaining feed particles as an aqueous phase in the presence of a fatty acid collector. The improvement in the process is characterized by the addition and use of an effective proportion of a promoter which is characterized as a foam modifier. Broadly, the preferred promoters useful in the froth flotation process of the present invention are amine oxides which can be represented by the following general structure:

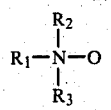

where, $R_1$ is a linear or branched, substituted or unsubstituted, saturated or unsaturated monovalent aliphatic, alicyclic, alicyclic-aliphatic, or aliphatic-aromatic group which may contain linkages of ether, amine, or sulfide, and $R_1$ has an effective chain length of about 1 to 30 atoms, and $R_2$ and $R_3$ each, independently, is a $C_1$–$C_{30}$ alkyl of alkanol group, or $R_2R_3$ is a heterocyclic residue.

Advantages of the present invention include excellent recovery yields of coarse size particles in the froth flotation process and improved flotation kinetics of the particles for increased throughput of particles in the process. Another advantage is the ability of the amine oxide promoter to suppress the negative effect of the extender fuel oil in the froth flotation process by stabilizing the froth to an abundant, yet manageable, layer which permits the coarse size particles to buoy more easily. A further advantage is that the amine oxide promoters presence in the process lowers the total proportion of fatty acid collector per unit weight of particles fed to the process. Yet another advantage of the present invention is the ability of the amine oxide promoter to cause a great change in the micellar structures of the fatty acid collector for promoting the dispersion of the collector and thus increasing collector adsorption on the ore particles. Such adsorption of the collector on the ore particles hydrophobizes the particles, a condition which is required to induce their flotation selectively from phosphate ores. A yet further advantage is that the presence of the amine oxide in the flotation system quite dramatically improves the selectivity for recovery of phosphatic and other particles in the froth flotation process. These and other advantages of the process will become readily apparent to those skilled in the art based upon the disclosure contained herein.

DETAILED DESCRIPTION OF THE INVENTION

The present invention works effectively and efficiently with phosphate ores and will be described in detail in connection therewith, but such description should not be construed as a limitation of the present invention. For example, the invention also works effectively and efficiently in the froth flotation of iron ores, tin ores, copper ores, and the like. Thus, the use of the promoters of the present invention is limited only by the ability of conventional anionic collectors (fatty acid collectors) to effectively enhance froth flotation of a fraction of the ore particles fed to the flotation process for their collection. Hence, the present invention should be construed broadly relative to suitable feeds for the flotation process.

The promoters of the invention which enhance the anionic froth flotation process can be classified as "foam modifiers". Foam modifiers include organic compounds, almost always surface-active, which when combined with a frother (surface-active agent) enhance the activity of the frother (or frothing agent) to a level unattainable by use of either the modifier or the frother alone, even at higher concentrations. Minor proportions of the foam modifier provide major enhancement of the frother even at diminished proportions of the frother.

Unexpectedly, such foam modifiers have been determined to effectively promote or enhance the anionic froth flotation process. The precise explanation of why and how the promoters function in the process is not fully understood, though the results of their function in the process clearly is evident. The major improvement imparted by the promoters is the improved recovery of the desired particles in the concentrate while at least maintaining, and usually improving, the selectively of the desired particles in the process. Suitable promoters for the invention, then, must so function. For any given effective concentration of collector and corresponding recovery and selectivity, addition of the promoter usually will result in an improvement both of the recovery and selectivity of recovery of the particles in the process. Such improvements also are seen even at reduced levels of the collector. Further reduction of the collector eventually will reach a point at which recovery and selectivity are reduced below that achieved with use of the collector alone. Evaluation of candidate foam modifiers as promoters for the process can be practiced readily by simple testing according to the procedure detailed in the examples.

The preferred promoters for the present invention are amine oxides and much of the description herein will be by specific reference to this preferred embodiment. It must be recognized, though, that such specific references are by way of illustration and not limitation of the present invention as other promoters will be described and the subject of exemplary support herein.

Extensive testing conducted during the course of developing the present invention revealed that amine oxides effectively improve an anionic flotation process. While the particular substituents attached to the amine oxide nucleus (the nitrogen-oxygen coordinate covalent group) do impact the activity of the amine oxide promoter in the process, such impact generally is less in magnitude than the impact which the mere presence of any amine oxide displays in the flotation process. This would indicate that the amine oxide nucleus is the active species in the process, though admittedly this is yet to be finally and fully confirmed. Further, while the electronic configuration of the amine oxide or other unique property may be responsible for its intense effect in the anionic flotation process, this to is not yet confirmed, but is hypothesis. It has been determined, however, that the amine oxide alone, i.e. with no anionic collector, in the flotation process is inadequate as a collector. Thus, the amine oxide does promote or enhance the anionic collector in the flotation process and is not solely responsible for the remarkable flotation results yielded by the present invention. About the only real limitation uncovered for the amine oxide promoters of the present invention is that they must be adequately dispersible or soluble in the flotation or conditioning solvent, almost always water, in order to promote the float. Methods for achieving such dispersibility will be discussed later herein.

The only other limitation on the amine oxide promoters arises from their synthesis in that certain substituents give rise to steric and electronic hindrance, as those skilled in this art are aware. Still, a plethora of amine oxide promoters can be easily and efficiently synthesized and have been determined to be effective in the flotation process. The amine oxide promoters suitable for use in the present invention can be represented in conventional fashion by the following general structure:

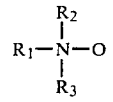

where, $R_1$, $R_2$, and $R_3$ are monovalent organic groups which are reactable with an amine (e.g. primary or secondary amine) to form a tertiary amine (e.g. such groups can alkylate, alkoxylate, etc. an amine) which tertiary amine then can be oxidized to form the amine oxide promoter. Broadly, $R_1$ can be a linear or branch, substituted or unsubstituted, saturated or unsaturated, monovalent aliphatic, alicyclic, alicyclic-aliphatic, or aliphatic-aromatic group which may contain linkages of ether, amine, amide or sulfide. $R_1$ will have an effective chain length of between about 1 and 30 atoms and advantageously about 6 and 22 atoms. The $R_2$ and $R_3$ groups generally will be the same for obvious ease of synthesis of the amine oxides, though such chemical structure identity is not a limitation of the invention. Broadly, $R_2$ and $R_3$ will be a $C_1$–$C_{30}$ aliphatic group, optionally substituted (e.g., hydroxyl or aromatic groups) and optionally containing linkages of ether, sulfide and the like. Advantageous $R_2$ and $R_3$ groups are $C_1$–$C_{30}$ alkyl, alkanol or polyoxyalkylene groups, and preferably $C_1$–$C_4$ alkyl or alkanol groups. $R_2R_3$ additionally can be a heterocyclic residue, e.g. of piperidine, morpholine, or the like. Presently preferred $R_1$ groups are $C_6$–$C_{22}$ alkyl, alkoxy-alkyl, and aminoalkyl groups. Presently preferred $R_2$ and $R_3$ groups are $C_1$–$C_3$ alkyl groups and $C_2$–$C_3$ 2-hydroxyalkyl groups.

Tertiary amine equivalents (heterocyclic, acylic, etc.) also can be oxidized to form amine oxides. Thus, tertiary amines and equivalents thereof for present purposes comprise a nitrogen atom in a molecule wherein no protons are attached to the nitrogen atom. Amine oxides of such tertiary amine equivalents can be represented as follows:

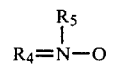

(II)

where $R_4$ and $R_5$ are organic groups including $R_4R_5$ being a heterocyclic residue. $R_4$ and $R_5$ each advantageously can be a $C_1$–$C_{30}$ aliphatic group. Examples of such tertiary amine equivalents useful in the present invention include for example, pyridine, pyrazole, imidazolines, picolines, and the like.

Representative amine oxide promoters for use in the present invention include, for example, those amine oxides with the following substituents from structure I:

| $R_1$ | $R_2$ and $R_3$ |
|---|---|
| $CH_3-(CH_2)_{11-14}O-(CH_2)_3-$ | $-CH_2-CH(OH)-CH_2$ |
| $CH_3-(CH_2)_{11-14}O-(CH_2)_3-$ | $-CH_2-CH(OH)-CH_2-O-C(CH_3)_2-CH_3$ |
| $CH_3-(CH_2)_{11-14}O-(CH_2)_3-$ | $-CH_2-CH(OH)-CH_2-CH_3$ |
| $CH_3-(CH_2)_7-O-(CH_2)_3-$ | $-CH_2-CH(OH)-CH_2-CH_3$ |
| $CH_3-(CH_2)_{11-14}O-(CH_2)_3-$ | $-CH_2-CH(OH)-O$ |
| $CH_3-(CH_2)_{11}-$ | $-CH_3$ |

Note that some of the above amine oxides are the novel anhydrous amine oxides of Earl and Hickman disclosed in commonly assigned application U.S. Ser. No. 106,746 filed on Dec. 26, 1979, which anhydrous amine oxides have been determined to function in the anionic flotation process of the present invention.

Synthesis of the amine oxide promoters is routine and generally involves the reaction of a suitable tertiary amine with a peroxidizing agent, preferably hydrogen peroxide, at temperatures of about 60° to 80° C. for forming the amine oxide. This synthesis may be carried out in aqueous solvent, in an alcohol solvent, or without solvent for those novel anhydrous amine oxides of Earl and Hickman, supra. Peracids also can be important reagents for this synthesis (see March, *Advanced Organic Chemistry,* 2nd Edition, page 1111, McGraw-Hill, Inc., New York, N.Y. 1977). The nitrogen-oxygen linkage in the amine oxide is a coordinate covalent bond and such amine oxides can be amphoteric depending upon the pH. Whether such amphoteric property of the amine oxide is important in its effectiveness as a promoter for froth flotation is unknown and is not a limitation of the invention since the amine oxide promoters, in fact, are effective in froth flotation as disclosed by the present invention. Synthesis of the tertiary amines which can be converted to the amine oxide promoters is conventional and many of such tertiary amines can be purchased from commercial sources. The examples will detail some representative synthesis schemes for synthesizing the tertiary amines and their conversion to the amine oxide promoters. Certainly those skilled in the art will appreciate how such amine oxide promoters can be synthesized. The amine oxide promoters are used in an effective proportion for promoting the froth flotation process and generally such proportion ranges from about 0.01 g/kg to about 0.5 g/kg (grams of amine oxide per kilogram of ore).

Additional classes of foam modifiers which have been determined to effectively promote the anionic froth flotation process include, for example, amides, imidazolines, amphoterics such as amido-betaines, and the like. The apparent commonality of these compounds (and amine oxides) is their traditionally recognized foam modifying characteristics. Accordingly, it is expected that additional traditional foam modifiers may function in the process of the present invention.

The anionic collectors which are used to effect the selective flotation process generally are those anionic collectors conventionally used in mineral froth flotation processes, though specially prepared anionic collectors may be used as is necessary, desirable, of convenient. More often, the promoting effect of the amine oxide is so great relative to the anionic collector effect that the particular type of an anionic collector used is of less importance in the process, though its presence is absolutely necessary. Conventional anionic collectors, for example, comprise carboxylic acids (fatty acids) including vegetable oil fatty acids, tall oil fatty acids, fatty acids derived from animal fat, marine oils, synthetic carboxylic acids and combinations of such fatty acids. Additional collectors include sulfates, sulfonates, lignin and lignin-derived acids, petroleum-based acids, and the like. A commercially popular anionic collector comprises crude tall oil carboxylic acids derived as a by-product from the paper industry. Generally, the proportion of anionic collector used in the froth flotation process ranges from about 0.5–1.5 g/kg and typically this proportion is about 1.0 g/kg (grams of collector per kilogram of ore).

Other chemicals which are conventionally added in the conditioning step for conditioning the ore prior to admission to the flotation process include non-polar hydrocarbon oils which enhance the beneficial effect of the anionic collectors and slime depressants. Typical non-polar hydrocarbon oils include synthetic coal oil, fuel oil, and various petroleum oils. Often, such hydrocarbon oils are admixed with the carboxylic acid collectors and such mixture used in the flotation process. Conventionally, no frothing agents are used in anionic flotation processes, though the use of such frothers, e.g. alcohols, is not forbidden in the present invention. Note that the promoters permit reduction of such extender oils (eg. fuel oil) in the process which eases waste disposal problems associated with such oils, reduces consumption of a scarce fossil fuel, and reduces exposure to potentially health hazardous fuel oils.

In practicing the present invention, the mineral ore to be subjected to the froth flotation process can be comminuted or attrited, though certain beach sand size ores may bypass this step. Phosphate ores, for example, traditionally are screened to remove coarse phosphate pebbles (usually larger than about 1.15 mm) and then attrition scrubbed and classified to remove fine clay minerals referred to as slimes in order to prepare the sands for admission to the first step of the flotation process. In the present invention, however, the ore can range in size on up to about 14 mesh (Tyler sieves series and corresponding to about 1.2 mm) and such coarse fraction ranging from about 35 to 14 mesh (0.4–1.2 mm) effectively floated in the present process. There is no real lower size restriction on the ore fed to the process though typically the ore ranges down to about 150 mesh (0.1 mm). Preferred feed particles for the process include phosphate ores, iron ores, tin ores, and copper ores, though the present invention can be used effectively on any particle which is susceptible to selective flotation using conventional anionic collectors.

Next, most ores are conditioned by the addition of the anionic collector and promoter, optionally containing the extender oil. Stepwise conditioning with the individual chemical additives may be practiced also as well as addition of the chemicals directly to the flotation cell.

Conditioning of the ore by addition of all chemicals thereto, though, is preferred for the present invention. Conditioning times for most ores generally ranges from about 1 to 5 minutes or thereabouts. Conditioning is conducted at high percent solids, normally 70%, in water as the main solvent and such aqueous conditioning bath typically has a pH of about 8.5 to 9.5 for phosphate ores, for example. In this connection, it should be noted that the promoter need only be dispersible as a liquid or soluble in the aqueous bath in order to be in proper form for use in the flotation process. Thus, the promoter often will be in solvent for admission to the flotation process, conveniently at about 10–30% actives (non-volatile solids) concentration. Suitable solvents for the promoter may be water, alcohol, and the like in mixtures thereof. Protonation of some promoters for dispersibility in water may be practiced as is necessary, desirable or convenient. Note further that tests of the present invention have determined that use of the amine oxide promoter in an alcohol solvent does not adversely effect the flotation process by the presence of the alcohol.

The conditioned ore then is admitted to a conventional flotation cell in a proportion of about 15–30%, preferably 20%, ore solids by weight at a flotation temperature desirably at about room temperature or 25° C. It is to be noted that variations in the ore solids concentration and flotation temperature will have little, if any, effect on the process due to the intense activity displayed by the amine oxide promoter in the flotation process. For phosphate ore, for example, the pH of the flotation cells is maintained at about 8.5–9.0. Froth flotation conditions for present purposes comprehend the water temperature, air flow, ore solids concentration in the flotation cell, composition and concentration of additives (for example, extender oil), and similar conventional factors. Flotation separation times can be as short as about 30 seconds using the amine oxide promoter on up to about 2 minutes, of course depending upon the concentration of ore in the cell, the particular design of the cell utilized, and a variety of other factors well known to those artisans skilled in this art. Recoveries in excess of 80% and often in excess of 90% on the average of the coarser fraction of ore fed to the process can be realized by the present invention using lower concentration levels of the flotation reagents (eg. fatty acids and fuel oils) compared to the conventional levels of such reagents. Further, the preferred amine oxide promoters of the present invention are sufficiently selective in the float so that the rougher float of phosphate ore may serve as the entire separation process and resort to a cleaner float becomes unnecessary.

The following examples show how the present invention can be practiced, but should not be construed as limiting. In this application, all percentages and proportions are by weight, all temperatures are in degrees centigrade, all units are in the metric system, and all mesh sizes are in Tyler standard sieve series, unless otherwise expressly indicated. Also, all references cited herein are expressly incorporated herein by reference.

IN THE EXAMPLES

In the examples, phosphate ores from Florida were conditioned prior to flotation in water (tap water) at room temperature (25° C.). Five hundred gram samples of the ore, −14 to +150 mesh (Tyler Standard Sieve Series) fraction, were deslimed by simple washing and decantation until about 80% of the original slime content had been removed. Each sample then was conditioned with the desired proportion of R-200 fatty acid (a blend of tall oil fatty acids AND #5 fuel oil in a 60:40 weight ratio, respectively,) plus an additional proportion of #5 fuel as an extender, and the amine oxide promoter. The amine oxide promoter used (except as indicated in Examples 7, 9, and 11) was prepared in alcohol solvent (isobutoxy-2-propanol) where the amine oxide is the reaction product of hydrogen peroxide and a tertiary amine, $CH_3—(CH_2)_{11-14}—O—(CH_2)_3—N—(CH_2—CH_2—OH)_2$, in the indicated alcohol solvent at an amine oxide actives concentration of 20% by weight.

The thus-formed slurry with pH adjusted to 8.5–9.0 with NaOH was conditioned for 2 minutes at 1500 rpm. The conditioned and reagentized pulp then was transferred to a Wemco laboratory flotation cell (Wemco Division of Envirotech. Corp., Sacramento, Calif.), diluted to 15% solids with additional tap water, and flotation commenced at 1,000 rpm until the collected froth showed no more collected particles. Flotation conditions included a temperature of about 25° C. and about 5 minute flotation time. All values of collector, fuel oil, and promoter in the Tables are on an actives basis regardless of the concentration of the ingredient as used.

Selectivity Indices (SI) for the flotation tests were calculated according to the following formula:

$$SI = \frac{R - C}{100 - C} \; \frac{c - f}{c_{max} - f} \times 100$$

where,

C = wt-% of concentrate

R = % of recovery of BPL in concentrate c = % of BPL in concentrate (by analysis)

$c_{max}$ = maximum % of BPL recoverable in concentrate f = % of BPL in feed (by analysis).

The value for $c_{max}$ used is 76% since this figure (for BPL analysis) represents essentially full recovery of available phosphate values in the feed.

EXAMPLE 1

The phosphate ore used in this example was supplied from a Big-4 phosphate mine of Borden-Amax Company at Bradley, Fla. The following flotation results were realized:

TABLE 1

| | Reagent Concentration (g/Kg)[1] | | | BPL Analysis (wt. %) | | % BPL Recovery in | |
|---|---|---|---|---|---|---|---|
| Test No. | R-200 | #5 Fuel Oil | Promoter[3] | Conc.[2] | Tails | Concentrate | SI |
| 1 | 0.266 | 0.232 | — | 65.3 | 8.5 | 52.6 | 37.5 |
| 2 | 0.266 | 0.232 | 0.008 | 68.6 | 6.6 | 61.6 | 48.8 |
| 3 | 0.266 | 0.232 | 0.016 | 65.8 | 4.6 | 78.0 | 60.1 |
| 4 | 0.266 | 0.232 | 0.024 | 61.6 | 4.4 | 80.7 | 56.9 |
| 5 | 0.266 | 0.232 | 0.032 | 56.9 | 2.5 | 88.5 | 57.6 |

[1]grams of reagent per kilogram of ore in all examples
[2]conc. is the concentrate product
[3]amine oxide actives basis in all examples These results demonstrate the intense effect which small amounts of the amine oxide have in the flotation process for increasing the selectivity of phosphate ore flotation in short flotation times (5 minutes).

EXAMPLE 2

In this example, the proportion of fatty acid collector and fuel oil extender were increased from their proportions used in Example 1 for flotation of another lot of the ore specified in Example 1. The following results were obtained.

TABLE 2

| Test No. | Reagent Concentration (g/Kg) R-200 | #5 Fuel Oil | Promoter | BPL Analysis (wt. %) Conc. | Tails | % BPL Recovery in Concentrate | SI |
|---|---|---|---|---|---|---|---|
| 6 | 0.532 | 0.464 | — | 57.2 | 4.2 | 79.5 | 50.4 |
| 7 | 0.532 | 0.464 | 0.008 | 61.8 | 2.1 | 90.6 | 58.0 |
| 8 | 0.532 | 0.464 | 0.016 | 57.6 | 2.3 | 90.4 | 59.9 |
| 9 | 0.532 | 0.464 | 0.024 | 57.8 | 1.4 | 93.7 | 63.4 |
| 10 | 0.532 | 0.464 | 0.032 | 46.0 | 1.5 | 93.6 | 44.9 |

The results again demonstrate the beneficial promoting effect which the amine oxide promoter displays in enhancing the selectivity of the flotation process. Apparently, the proportion of promoter in Test No. 10 exceeded an effective proportion and reduced rather than enhanced selectivity, even though the percent of phosphate particles recovered in the concentrate was substantially greater than in the comparison run.

EXAMPLE 3

Using another lot of the ore described in Example 1, a standard commercial dosage of the collector and extender (Run No. 11) are compared to two runs of the previous examples which use lower such dosages in combination with the amine oxide promoter.

TABLE 3

| Test No. | Reagent Concentration (g/Kg) R-200 | #5 Fuel Oil | Promoter | BPL Analysis (wt. %) Conc. | Tails | % BPL Recovery in Concentrate | SI |
|---|---|---|---|---|---|---|---|
| 11 | 1.064 | 0.928 | — | 54.2 | 1.7 | 92.0 | 56.5 |
| 9 | 0.532 | 0.464 | 0.024 | 57.8 | 1.4 | 93.7 | 63.4 |
| 5 | 0.266 | 0.232 | 0.032 | 56.9 | 2.5 | 88.5 | 57.5 |

The results demonstrate that the amine oxide promoter, at very low concentrations, can provide equivalent BPL recovery and selectivity at much lower concentrations of collector and extender. Note especially Test No. 5 wherein at one-fourth the collector concentration that equivalent selectivity were achieved.

EXAMPLE 4

Using another lot of the ore of Example 1, additional flotation runs were conducted at a higher pulp density (weight solids of ore in the flotation cell) of 25% instead of the 15% pulp density used in the previous examples. The following results were realized.

TABLE 4

| Test No. | Reagent Concentration (g/Kg) R-200 | #5 Fuel Oil | Promoter | BPL Analysis (wt. %) Conc. | Tails | % BPL Recovery in Concentrate | SI |
|---|---|---|---|---|---|---|---|
| 12 | 0.399 | 0.348 | — | 68.6 | 4.9 | 79.2 | 64.4 |
| 13 | 0.399 | 0.348 | 0.04 | 62.3 | 2.0 | 89.9 | 67.0 |

These results show the amine oxide promoter permits higher recovery and at least equivalent, if not slightly improved, BPL selectivity at higher pulp densities than are typically used in commercial phosphate flotation operations.

EXAMPLE 5

In this example, the phosphate ore was supplied from a phosphate mine of C.F. Industries from Wauchula, Fla. The following flotation results were obtained.

TABLE 5

| Test No. | Reagent Concentration (g/Kg) R-200 | Promoter | BPL Analysis (wt. %) Conc. | Tails | % BPL Recovery in Concentrate | SI |
|---|---|---|---|---|---|---|
| 14 | 0.565 | — | 61.2 | 10.5 | 58.4 | 35.4 |
| 15 | 0.565 | 0.008 | 61.7 | 5.2 | 81.4 | 55.3 |
| 16 | 0.565 | 0.016 | 63.4 | 6.8 | 75.0 | 51.8 |
| 17 | 0.565 | 0.024 | 57.3 | 6.7 | 75.4 | 44.2 |

Note that though no extender was used during the float, the amine oxide promoter still provided a significant improvement due to the recovery of BPL by the flotation process.

EXAMPLE 6

Using the ore source of Example 5, another run was conducted in order to compare a standard commercial dosage of collector to a run of Example 5 using a lower dosage of the collector in conjunction with the amine oxide promoter.

TABLE 6

| Test No. | Reagent Concentration (g/Kg) R-200 | Promoter | BPL Analysis (wt. %) Conc. | Tails | % BPL Recovery in Concentrate | SI |
|---|---|---|---|---|---|---|
| 18 | 1.130 | — | 49.5 | 4.8 | 85.0 | 40.1 |
| 15 | 0.565 | 0.008 | 61.7 | 5.2 | 81.4 | 55.3 |

The above-tabulated results show eqivalent BPL recovery in the concentrate using less collector. These results further show that such equivalent BPL recovery in the concentrate was accompanied by a more selective float of phosphate particles. Truly, a unique achievement results from use of the amine oxide promoter.

EXAMPLE 7

In this example, the phosphate ore was supplied from a Mobil Chemical Company phosphate mine at Fort Meade, Fla. Several different amine oxides also were used in this example as follows:

| Test No. | Amine Oxide Type |
|---|---|
| 38 | none |
| 45 | amine oxide of Example 1 |
| 48 | amine oxide of Example 1 at 10% actives in alcohol solvent. |
| 49 | amine oxide of Example 1 made by oxidizing the tertiary amine in water |
| 50 | $(CH_3)_2CH-(CH_2)_5-O-(CH_2)_3-N(CH_2-CH_2-OH)_2-O$ |

-continued

| Test No. | Amine Oxide Type |
|---|---|
| 51 | $CH_3-(CH_2)_5-O-(CH_2)_3-N(CH_2-CH_2-OH)_2-O$ |
| 52 | $CH_3-(CH_2)_7-O-(CH_2)_3-N(CH_2-CH_2-OH)_2-O$ |

All of the amine oxides, except the amine oxide of run 45 (20% actives as stated before), were supplied at 10% by weight amine oxide in water as the solvent for runs 49–52 and in the alcohol solvent for runs 45 and 48.

TABLE 7

| Test No. | Reagent Concentration (g/Kg) R-200 | #5 Fuel Oil | Promoter | BPL Analysis (wt. %) Conc. | Tails | % BPL Recovery in Concentrate | SI |
|---|---|---|---|---|---|---|---|
| 38 | 0.532 | 0.464 | — | 65.7 | 19.9 | 50.3 | 27.0 |
| 45 | 0.532 | 0.464 | 0.04 | 65.2 | 4.5 | 92.3 | 65.2 |
| 48 | 0.532 | 0.464 | 0.02 | 65.6 | 10.5 | 81.4 | 53.3 |
| 49 | 0.532 | 0.464 | 0.02 | 66.8 | 7.9 | 85.3 | 59.8 |
| 50 | 0.532 | 0.464 | 0.02 | 67.4 | 12.3 | 73.4 | 48.5 |
| 51 | 0.532 | 0.464 | 0.02 | 68.1 | 13.3 | 71.9 | 47.7 |
| 52 | 0.532 | 0.464 | 0.02 | 63.1 | 11.6 | 75.6 | 44.0 |

The above-tabulated results show that several different types of amine oxides work effectively and efficiently in the flotation process. Moreover, there does appear to be a beneficial effect which the alcohol solvent (Run No. 45) displays in the process.

EXAMPLE 8

Using the ore source of Example 7, several different concentrations of the amine oxide promoter of Example 1 were evaluated in the float with the following results.

TABLE 8

| Test No. | Reagent Concentration (g/Kg) R-200 | #5 Fuel Oil | Promoter | BPL Analysis (wt. %) Conc. | Tails | % BPL Recovery in Concentrate | SI |
|---|---|---|---|---|---|---|---|
| 38 | 0.532 | 0.464 | — | 65.7 | 19.9 | 50.3 | 27.0 |
| 41 | 0.532 | 0.464 | 0.008 | 68.3 | 15.6 | 59.4 | 38.0 |
| 42 | 0.532 | 0.464 | 0.016 | 66.5 | 13.6 | 71.6 | 44.9 |
| 43 | 0.532 | 0.464 | 0.024 | 66.5 | 7.9 | 85.3 | 59.3 |
| 44 | 0.532 | 0.464 | 0.032 | 65.5 | 5.5 | 90.4 | 63.4 |
| 45 | 0.532 | 0.464 | 0.040 | 65.2 | 4.5 | 92.3 | 65.2 |

The above-tabulated results again demonstrate the effectiveness of small concentrations of the promoter in the flotation process. Moreover, such effectiveness is demonstrated for a source of phosphate ore different than the source of Examples 1–4 and 5–6. The universal applicability of the promoters, thus, is proven.

Example 9

Using the ore source of Example 7, several different concentrations of the amine oxide promoter of run number 48 of Example 7 were evaluated in the float with the following results.

TABLE 9

| Test No. | Reagent Concentration (g/Kg) R-200 | #5 Fuel Oil | Promoter | BPL Analysis (wt. %) Conc. | Tails | % BPL Recovery in Concentrate | SI |
|---|---|---|---|---|---|---|---|
| 38 | 0.532 | 0.464 | — | 65.7 | 19.9 | 50.3 | 27.0 |
| 46 | 0.532 | 0.464 | 0.004 | 67.3 | 11.2 | 77.6 | 52.1 |
| 57 | 0.532 | 0.464 | 0.012 | 66.5 | 9.8 | 80.7 | 54.2 |
| 48 | 0.532 | 0.464 | 0.020 | 65.6 | 10.5 | 81.4 | 53.3 |

EXAMPLE 10

Using the ore source of Example 7, the amine oxide promoter of Example 1 was evaluated with a lower dosage of collector and extender than is commercially recommended and used. The following results were obtained.

TABLE 10

| Test No. | Reagent Concentration (g/Kg) R-200 | #5 Fuel Oil | Promoter | BPL Analysis (wt. %) Conc. | Tails | % BPL Recovery in Concentrate | SI |
|---|---|---|---|---|---|---|---|
| 40 | 1.064 | 0.928 | — | 66.5 | 7.5 | 85.2 | 59.6 |
| 45 | 0.532 | 0.464 | 0.04 | 65.2 | 4.5 | 92.3 | 65.2 |

The above-tabulated results clearly show the intensity of the amine oxide promoter in the float even when diminished dosages of collector are used.

EXAMPLE 11

Using another lot of very coarse ore from the Big-4 mine of Borden-Amax Company at Bradley, Fla., several different promoters were evaluated as to their functionality in the anionic flotation process. The following promoters were evaluated.

| Test No. | Promoter |
|---|---|
| 70 | Comparison run - no promoter |
| 74 | Coco amido betaine (30% actives concentration) |
| 76 | Coco hydroxyethyl imidazoline |
| 78 | Lauric superamide (commercial grade) |
| 81 | Lauric diethanolamide (commercial grade) |

The following flotation results were obtained:

TABLE 11

| Test No. | Reagent Concentration (g/Kg) R-200 | #5 Fuel Oil | Promoter | BPL Analysis (wt. %) Conc. | Tails | % BPL Recovered in Concentrate | SI |
|---|---|---|---|---|---|---|---|
| 70 | 0.798 | 0.696 | — | 62.4 | 17.1 | 40.5 | 23.6 |
| 74 | 0.798 | 0.696 | 0.006 | 61.1 | 18.8 | 65.2 | 40.1 |
| 76 | 0.798 | 0.696 | 0.020 | 62.9 | 16.7 | 67.2 | 43.8 |
| 78 | 0.798 | 0.696 | 0.020 | 60.6 | 19.2 | 80.5 | 52.7 |
| 81 | 0.798 | 0.696 | 0.020 | 61.2 | 19.0 | 80.2 | 53.3 |

The above-tabulated results demonstrate that a wide variety of promoters (foam modifiers) are effective in the flotation process.

I claim:

1. In a froth flotation process where preselected solid particles are selectively separated under anionic froth flotation conditions as a froth phase from remaining solid feed particles as an aqueous phase in the presence of an anionic collector, the improvement characterized by the addition of an effective proportion of an amine oxide promoter for improving the selectivity of recovery of said preselected particles.

2. The froth flotation process of claim 1 wherein the effective proportion of said promoter is between about 0.01 g and 0.5 g per kilogram of said feed particles.

3. The process of claim 1 wherein said preselected solid particles are not substantially larger than about 1.2 mm average particle size.

4. The process of claim 1 wherein said amine oxide promoter is represented by the following general structure:

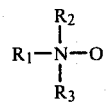

where, $R_1$, $R_2$, and $R_3$ are monovalent organic groups, or $R_1$ is a monovalent organic group and $R_2R_3$ is a heterocyclic residue; or $R_2$ and $R_3$ are the same group, R, joined by a double bond to said nitrogen atom wherein $R_1$ and R are organic groups or a heterocyclic residue.

5. The process of claim 4 wherein $R_1$ is a linear or branched, substituted or unsubstituted, saturated or unsaturated, monovalent aliphatic, alicyclic, alicyclic-aliphatic, or aliphatic-aromatic group which may contain linkages of ether, amine, or sulfide, and $R_1$ has an effective chain length of about 1 to 30 atoms, and $R_2$ and $R_3$ each, independently, is a $C_1$–$C_{30}$ linear or branched, substituted or unsubstituted, saturated or unsaturated monovalent $C_1$–$C_{30}$ aliphatic group which may contain linkages of ether or sulfide, or $R_2R_3$ is a heterocyclic residue.

6. The process of claim 5 wherein $R_1$ is a $C_6$–$C_{20}$ alkyl, alkoxy-alkyl, or aminoalkyl group.

7. The process of claim 5 or 6 where $R_2$ and $R_3$ each is a $C_1$–$C_3$ alkyl or alkanol group.

8. The process of claim 5 wherein $R_2R_3$ is a residue of a heterocyclic group selected from a piperidino group and a morpholino group.

9. The process of claim 4 wherein said amine oxide promoter is provided in aqueous dispersion.

10. The process of claim 4 wherein said amine oxide promoter is provided dispersed in an alcohol solvent.

11. The process of claim 4 wherein said amine oxide promoter is selected from the group consisting of amine oxides having the following substituents:

| $R_1$ | $R_2$ and $R_3$ |
|---|---|
| $CH_3-(CH_2)_{11-14}O-(CH_2)_3-$ | $-CH_2-CH(OH)-CH_2$ |
| $CH_3-(CH_2)_{11-14}O-(CH_2)_3-$ | $-CH_2-CH(OH)-CH_2-O-C(CH_3)_2-CH_3$ |
| $CH_3-(CH_2)_{11-14}O-(CH_2)_3-$ | $-CH_2-CH(OH)-CH_2-CH_3$ |
| $CH_3-(CH_2)_7-O-(CH_2)_3-$ | $-CH_2-CH(OH)-CH_2-CH_3$ |

-continued

| $R_1$ | $R_2$ and $R_3$ |
|---|---|
| $CH_3-(CH_2)_{11-14}O-(CH_2)_3-$ | $-CH_2-CH(OH)-O$ |
| $CH_3-(CH_2)_{11}-$ | $-CH_3$ |

12. The process of claim 1 wherein said feed particles comprise phosphate ore.

13. The process of claim 1 wherein said feed particles are conditioned with said anionic collector and said prior to said flotation.

14. The process of claim 1 wherein said froth flotation conditions include a flotation temperature of between about 15° and 40° C., a concentration of particles of between about 15 and 30% by weight, and the addition of a non-polar hydrocarbon oil extender.

15. The process of claim 14 wherein said extender comprises fuel oil.

16. The process of claim 1 wherein said collector comprises tall oil fatty acids.

17. In a froth flotation process wherein preselected solid particles not substantially larger than about 1.2 mm average particle size are selectively separated under froth flotation conditions as a froth phase from remaining solid feed particles as an aqueous phase in the presence of a fatty acid collector, the improvement characterized by conditioning said feed particles in an aqueous conditioning bath with said collector, a hydrocarbon oil extender, and an effective proportion of an amine oxide promoter and then subjecting said conditioned feed particles to said froth flotation, said amine oxide promoter represented by

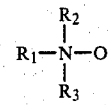

where, $R_1$ is an organic group having an effective chain length of about 1 to 22 atoms, and $R_2$ and $R_3$ each is a $C_1$–$C_4$ alkyl or alkanol group or a polyoxyalkylene group derived from said $C_1$–$C_4$ alkanol group.

18. The process of claim 19 wherein $R_1$ is a $C_6$–$C_{22}$ alkyl, alkoxy-alkyl, or aminoalkyl group; and $R_2$ and $R_3$ each is a $C_1$–$C_3$ alkyl or alkanol group.

19. The process of claim 17 wherein said amine oxide promoter is provided as an aqueous dispersion thereof.

20. The process of claim 17 wherein said amine oxide is provided in an alcohol solvent wherein said alcohol solvent is said frothing agent.

21. The process of claim 17 wherein said feed particles comprise phosphate ore.

22. A froth flotation process for substantially selectively separating phosphatic particles as a froth phase from remaining feed particles as an aqueous phase characterized by subjecting said feed particles to froth flotation under anionic froth flotation conditions in the presence of a carboxylic acid collector and an effective proportion of an amine oxide promoter, and separately recovering said froth phase containing said phosphatic particles and said aqueous phase containing said remaining feed particles.

23. The froth flotation process of claim 22 wherein said feed particles are conditioned in an aqueous conditioning bath of said collector and said promoter prior to said froth flotation.

24. The froth flotation process of claim 22 or 23 wherein said amine oxide promoter is represented by

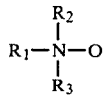

where $R_1$ is a linear or branched, substituted or unsubstituted, saturated or unsaturated, monovalent aliphatic, alicyclic, alicyclic-aliphatic, or aliphatic-aromatic group which may contain linkages of ether, amine, or sulfide, and $R_1$ has an effective chain length of about 1 to 30 atoms, and $R_2$ and $R_3$ each, independently, is a $C_1$–$C_{30}$ linear or branched, substituted or unsubstituted, saturated or unsaturated monovalent $C_1$–$C_{30}$ aliphatic group which may contain linkages of ether or sulfide, or $R_2R_3$ is a heterocyclic residue.

25. The froth flotation process of claim 24 wherein $R_1$ is a $C_6$–$C_{20}$ alkyl, alkoxy-alkyl, or aminoalkyl group; and $R_2$ and $R_3$ each is a $C_1$–$C_3$ alkyl or alkanol group, or a polyoxyalkylene group derived from said $C_1$–$C_3$ alkanol group.

26. The froth flotation process of claim 22 or 23 wherein a non-polar hydrocarbon oil is included in said process.

27. The froth flotation process of claim 22 or 23 wherein said promoter is provided in an alcohol solvent.

28. The froth flotation process of claim 22 or 23 wherein said collector comprises a tall oil fatty acid.

29. The froth flotation process of claim 22 or 23 wherein said promoter is selected from the group of amine oxides having the following substituents:

| $R_1$ | $R_2$ and $R_3$ |
|---|---|
| $CH_3-(CH_2)_{11-14}O-(CH_2)_3-$ | $-CH_2-CH(OH)-CH_2$ |
| $CH_3-(CH_2)_{11-14}O-(CH_2)_3-$ | $-CH_2-CH(OH)-CH_2-O-C(CH_3)_2-CH_3$ |
| $CH_3-(CH_2)_{11-14}O-(CH_2)_3-$ | $-CH_2-CH(OH)-CH_2-CH_3$ |
| $CH_3-(CH_2)_7-O-(CH_2)_3-$ | $-CH_2-CH(OH)-CH_2-CH_3$ |
| $CH_3-(CH_2)_{11-14}O-(CH_2)_3-$ | $-CH_2-CH(OH)-O$ |
| $CH_3-(CH_2)_{11}-$ | $-CH_3$. |

30. The froth flotation process of claim 22 or 23 wherein the proportion of acid promoter is between about 0.01 g and 0.5 g per kilogram of said feed particles.

* * * * *